US008720880B2

(12) United States Patent
Awano

(10) Patent No.: US 8,720,880 B2
(45) Date of Patent: May 13, 2014

(54) POST-PROCESSING DEVICE AND IMAGE FORMING APPARATUS

(75) Inventor: Hiroaki Awano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 78 days.

(21) Appl. No.: 13/567,768

(22) Filed: Aug. 6, 2012

(65) Prior Publication Data

US 2013/0207334 A1 Aug. 15, 2013

(30) Foreign Application Priority Data

Feb. 14, 2012 (JP) ..... 2012-029813

(51) Int. Cl.
*B65H 37/04* (2006.01)

(52) U.S. Cl.
USPC ..... 270/58.17; 270/58.12; 270/58.16; 270/58.07; 399/407

(58) Field of Classification Search
USPC ..... 270/58.07, 58.08, 58.09, 58.1, 58.11, 270/58.12, 58.13, 58.14, 58.15, 58.16, 270/58.17; 399/407, 410
See application file for complete search history.

(56) References Cited

U.S. PATENT DOCUMENTS

| | | | | |
|---|---|---|---|---|
| 5,282,611 | A * | 2/1994 | Ueda et al. | 270/58.09 |
| 2010/0196074 | A1* | 8/2010 | Tsuchihashi et al. | 399/407 |
| 2011/0057378 | A1* | 3/2011 | Iguchi et al. | 270/58.11 |
| 2011/0148024 | A1* | 6/2011 | Iguchi | 270/58.09 |
| 2013/0043636 | A1* | 2/2013 | Gamo | 270/58.07 |

FOREIGN PATENT DOCUMENTS

| | | | |
|---|---|---|---|
| JP | 08175736 | A * | 7/1996 |
| JP | 3417994 | B2 | 6/2003 |
| JP | 2006232451 | A * | 9/2006 |
| JP | 2012206815 | A * | 10/2012 |

* cited by examiner

*Primary Examiner* — Patrick Mackey
(74) *Attorney, Agent, or Firm* — Sughrue Mion, PLLC

(57) ABSTRACT

A post-processing device includes a transport section transporting a sheet; a load section loading the sheet thereon; a first aligner moving the sheet while being in contact with a surface thereof to align the sheet; a second aligner moving the sheet while being in contact with an edge thereof to align the sheet; an alignment controller controlling the aligners to align the sheet based on a first mode in which they simultaneously align the sheet, and based on a second mode, for every predetermined number of sheets, in which one aligner aligns the sheet after the other aligner completes the alignment process; and a transport controller causing the transport section to transport the sheet at a reduced speed for every predetermined number of sheets so that the sheet reaches the load section after completion of the second-mode alignment process performed after a previous sheet is loaded on the load section.

18 Claims, 6 Drawing Sheets

POST-PROCESSING DEVICE AND IMAGE FORMING APPARATUS

CROSS-REFERENCE TO RELATED APPLICATIONS

This application is based on and claims priority under 35 USC 119 from Japanese Patent Application No. 2012-029813 filed Feb. 14, 2012.

BACKGROUND

Technical Field

The present invention relates to post-processing devices and image forming apparatuses.

SUMMARY

According to an aspect of the invention, there is provided a post-processing device including a transport section, a load section, a first aligner, a second aligner, an alignment controller, and a transport controller. The transport section transports a sheet transported at a predetermined speed from an upstream side toward a downstream side. On the load section, the sheet transported from the transport section is loaded. The first aligner moves the sheet transported to the load section while being in contact with a surface of the sheet so as to perform an alignment process on the sheet. The second aligner moves the sheet transported to the load section while being in contact with an edge of the sheet so as to perform an alignment process on the sheet. The alignment controller performs control such that the first aligner and the second aligner perform the alignment process on the sheet transported to the load section based on a first mode in which the second aligner performs the alignment process while the first aligner performs the alignment process on the sheet, and such that the first aligner and the second aligner perform the alignment process on the sheet transported to the load section based on a second mode, for every predetermined number of sheets, in which one of the first aligner and the second aligner performs the alignment process on the sheet after the other aligner completes the alignment process. The transport controller controls the transport section by causing the transport section to transport the sheet at a reduced speed relative to the predetermined speed for the every predetermined number of sheets so that the sheet transported at the reduced speed reaches the load section after completion of the alignment process based on the second mode performed after a previous sheet transported immediately prior to the sheet is loaded on the load section.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail below with reference to the appended drawings.

Image Forming System 1

Figure 1:
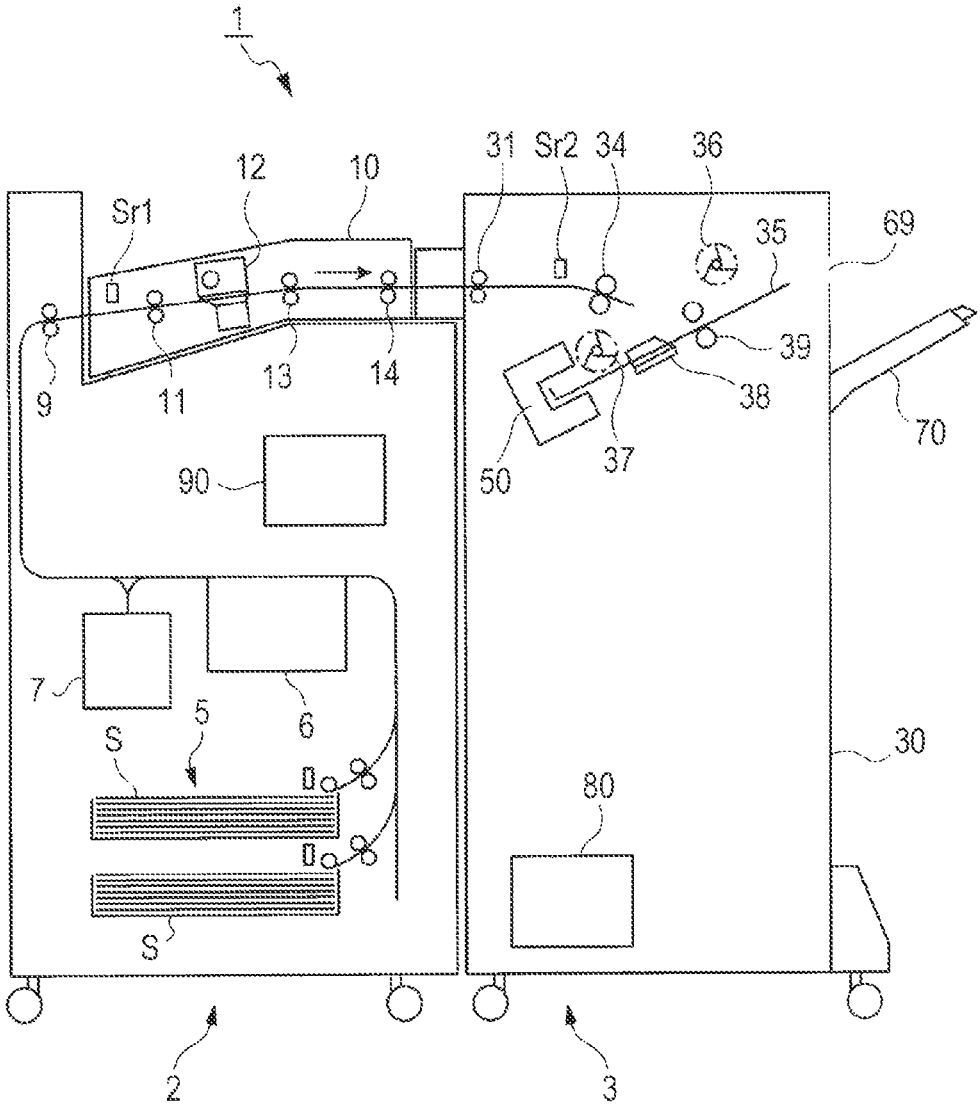
FIG. 1 schematically illustrates the configuration of an image forming system to which the exemplary embodiment is applied.

FIG. 1 schematically illustrates the configuration of an image forming system (image forming apparatus) 1 to which the exemplary embodiment is applied. The image forming system 1 shown in FIG. 1 includes, for example, an image forming device (image forming mechanism) 2, such as a printer or a copier, which forms an image based on an electrophotographic method, and a sheet processing device (post-processing device) 3 that performs post-processing on a sheet S having, for example, a toner image formed thereon by the image forming device 2.

Image Forming Device 2

The image forming device 2 includes a sheet feeding unit 5 that feeds sheets S on which images are to be formed, and an image forming unit 6 that forms an image on each of the sheets S fed from the sheet feeding unit 5. The image forming device 2 also includes a sheet inverting unit 7 that inverts the sheet S having the image formed thereon by the image forming unit 6, and a discharge roller 9 that discharges the sheet S having the image formed thereon. Moreover, the image forming device 2 includes a user interface 90 that receives information related to an image to be formed on each sheet S and a binding process from a user.

Sheet Processing Device 3

The sheet processing device 3 includes a transport unit 10 that transports each sheet S output from the image forming device 2 further downstream, and a post-processing device 30 that includes, for example, a compilation load section 35 for compiling the sheets S, and a stapler 50 for binding the edges of the sheets S together. In the example shown in FIG. 1, the sheet processing device 3 includes a controller 80 (alignment controller, transport controller) that controls the entire image forming system 1.

The transport unit 10 in the sheet processing device 3 includes a receiving roller (transport section) 11 constituted of a pair of rollers that receive each sheet S output from the image forming device 2 via the discharge roller 9 and that can increase and decrease the transport speed of the sheet S, and a puncher 12 that punches a hole, where necessary, in the sheet S received by the receiving roller 11. At the downstream side of the puncher 12, the transport unit 10 also has a first transport roller 13 constituted of a pair of rollers that transport the sheet S downstream, and a second transport roller 14 constituted of a pair of rollers that transport the sheet S toward the post-processing device 30. At the upstream side of the receiving roller 11, the transport unit 10 has a reception sensor Sr1 that detects the sheet S output from the image forming device 2 via the discharge roller 9.

The post-processing device 30 in the sheet processing device 3 includes a third transport roller 31 constituted of a pair of rollers that receive each sheet S from the transport unit 10 and transport the sheet S downstream. The post-processing device 30 also includes the aforementioned compilation load section 35 that is provided at the downstream side of the third transport roller 31 and that collects and accommodates multiple sheets therein, and an exit roller 34 constituted of a pair of rollers that discharge each sheet S toward the compilation load section 35. At the downstream side of the third transport roller 31, which is the upstream side of the exit roller 34, the post-processing device 30 includes an exit sensor Sr2 that detects the sheet S.

Moreover, the post-processing device 30 includes a first paddle 37 and a second paddle 36 that rotate so as to push each sheet S toward an end guide 35*b*, to be described later, of the compilation load section 35. Furthermore, the post-processing device 30 includes a tamper 38 for aligning the edges of the sheets S. The post-processing device 30 also includes an eject roller (sheet-bundle transport section) 39 that presses down on the sheets S stacked on the compilation load section 35 and rotates so as to transport a bundle of bound sheets.

Furthermore, the post-processing device 30 includes the aforementioned stapler 50 for binding the edges of the bundle of sheets S stacked on the compilation load section 35 together by using staples. The post-processing device 30 also has an opening 69 through which the sheet bundle is ejected outward from the post-processing device 30 by the eject roller 39, and a load section 70 on which sheet bundles ejected from the opening 69 are stacked so that the user may readily collect the sheet bundles. The load section 70 shown in FIG. 1 is of a so-called uphill type in which the load section 70 is inclined so that the downstream side of a sheet bundle in the ejecting direction is positioned higher than the upstream side thereof.

Structure of Compilation Load Section 35 and Surrounding Area Thereof

Next, the structure of the compilation load section 35 and a surrounding area thereof will be described with reference to FIGS. 2 and 3. Specifically, FIG. 2 schematically illustrates the configuration of the compilation load section 35 and the surrounding area thereof, and FIG. 3 schematically illustrates the configuration of the compilation load section 35 and the surrounding area thereof, as viewed in a direction indicated by an arrow III in FIG. 2.

Figure 2:
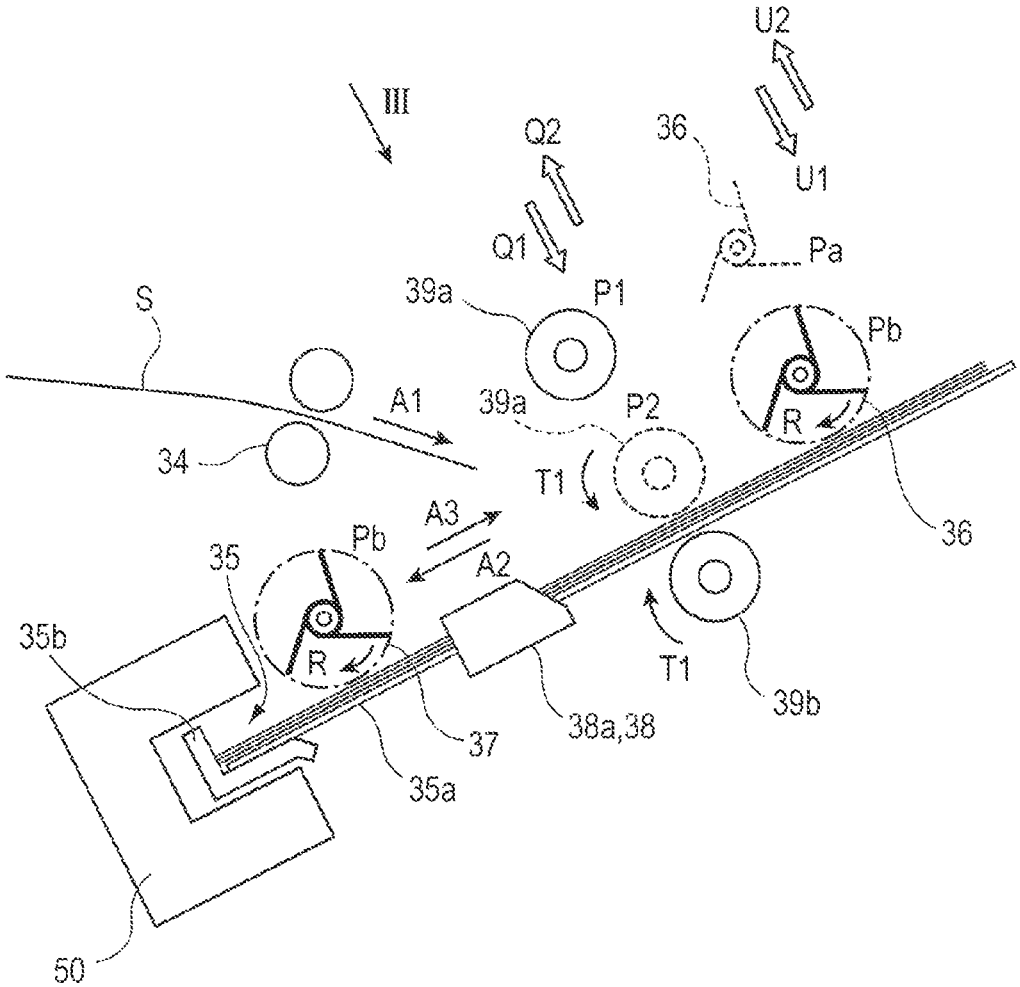
FIG. 2 schematically illustrates the configuration of a compilation load section and a surrounding area thereof.
Figure 3:
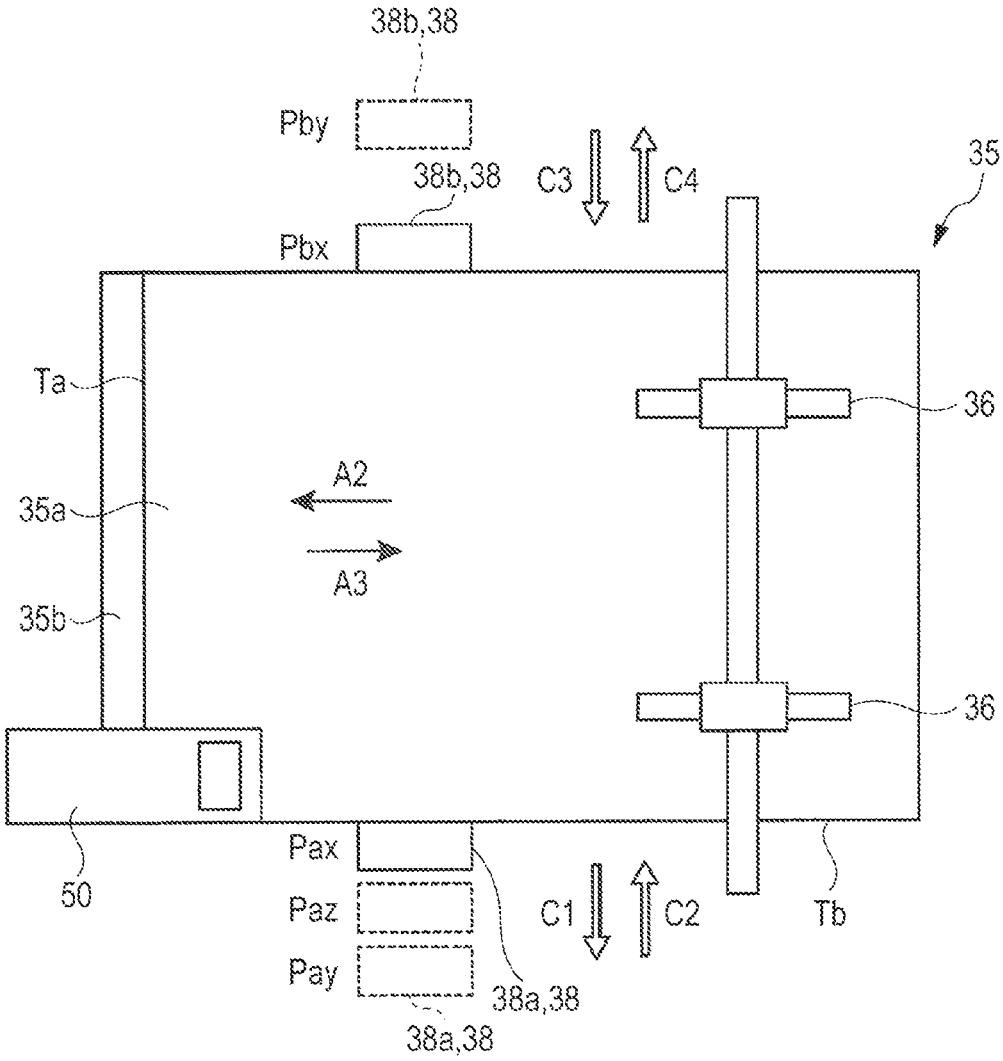
FIG. 3 schematically illustrates the configuration of the compilation load section and the surrounding area thereof, as viewed in a direction indicated by an arrow III in FIG. 2.

The lower side in FIG. 3 indicates the user side of the image forming system 1 and corresponds to the front side in FIGS. 1 and 2. For providing a clear understanding of the drawing, the first paddle 37 is not shown in FIG. 3.

The compilation load section 35 has a base 35*a* having an upper surface on which sheets S are loaded. As shown in FIG. 2, the base 35*a* is disposed slantwise such that the sheets S are made to fall along the upper surface. Moreover, the compilation load section 35 has the aforementioned end guide 35*b* that is disposed so as to align the leading edge, in the traveling direction, of each sheet S falling along the base 35*a*.

With regard to the movement of the sheets S on the compilation load section 35 and in the surrounding area thereof, which will be described in detail later, each of the sheets S is first fed toward the compilation load section 35 (see a first traveling direction A1 in FIG. 2), and the traveling direction is subsequently inverted so that the sheet S falls along the base 35*a* of the compilation load section 35 (see a second traveling direction A2 in FIG. 2). Then, the leading edges of the sheets S are aligned with each other, whereby a sheet bundle is formed. With regard to this sheet bundle, the traveling direction thereof is inverted so that the sheet bundle travels upward along the base 35*a* of the compilation load section 35 (see third traveling direction A3 in FIG. 2).

As shown in FIG. 3, in this exemplary embodiment, the ends of the base 35*a* of the compilation load section 35 are defined as follows. First, a leading end of the base 35*a* in the second traveling direction A2, which is the direction in which the sheets S fall along the upper surface of the base 35*a* of the compilation load section 35, will be referred to as "front end Ta". The front end Ta is in contact with the end guide 35*b*. Furthermore, an end of the base 35*a* that extends parallel to the second traveling direction A2 and is located at the user side (i.e., the lower side in FIG. 3) of the image forming system 1 will be referred to as "lateral end Tb".

As shown in FIG. 2, the second paddle 36 as an example of a first aligner is provided above the compilation load section 35 and at the downstream side of the exit roller 34 in the first traveling direction A1 of each sheet S. Furthermore, the second paddle 36 is provided such that the distance thereof relative to the base 35*a* of the compilation load section 35 is changeable by a driving force received from a motor or the like (not shown). In detail, the second paddle 36 is movable in directions indicated by arrows U1 and U2 in FIG. 2, such that the second paddle 36 moves toward the base 35*a* of the compilation load section 35 (to a position Pb denoted by a solid line) by moving in the direction of the arrow U1, or moves away from the base 35*a* of the compilation load section 35 (to a position Pa denoted by a dashed line) by moving in the direction of the arrow U2. Then, the second paddle 36 rotates in a direction indicated by an arrow R in FIG. 2 so that each sheet S transported in the first traveling direction A1 in FIG. 2 is pushed in the second traveling direction A2 above the compilation load section 35.

As shown in FIG. 2, the first paddle 37 is provided above the compilation load section 35 and at the downstream side of the second paddle 36 in the second traveling direction A2 of each sheet S. Unlike the second paddle 36, the distance between the first paddle 37 and the base 35*a* is not changeable. The first paddle 37 rotates in the direction of the arrow R in FIG. 2 so as to push each sheet S in the second traveling direction A2 above the compilation load section 35.

The second paddle 36 and the first paddle 37 are configured to align the leading edge, in the second traveling direction A2, of each sheet S falling along the base 35*a*. Then, the second paddle 36 and the first paddle 37 intermittently come into contact with the surface of the uppermost sheet S and utilize the friction with the surface of the sheet S so as to transport the sheet S in the transport direction. If there is a stack of multiple sheets S, since the second paddle 36 and the first paddle 37 are not able to come into contact with the sheet or sheets S stacked below the uppermost sheet S, it is difficult for the second paddle 36 and the first paddle 37 to align the sheet or sheets S stacked below the uppermost sheet S. In other words, the second paddle 36 acts on the surface of each sheet S transported in the first traveling direction A1 in FIG. 2 so as to frictionally redirect the sheet S in the opposite direction.

Referring to FIG. 3, the tamper 38 as an example of a second aligner includes a first tamper 38*a* and a second tamper 38*b* that are disposed facing each other with the compilation load section 35 interposed therebetween. Specifically, the first tamper 38*a* and the second tamper 38*b* are disposed facing each other in a direction (i.e., the vertical direction in FIG. 3) that intersects the second traveling direction A2. The first tamper 38*a* and the second tamper 38*b* are provided such that the distance between the first tamper 38*a* and the second tamper 38*b* is changeable by a driving force received from a motor or the like (not shown).

The tamper 38 is configured to align the edges, extending in the traveling direction, of each sheet S falling along the base 35*a*. Specifically, the first tamper 38*a* is disposed in a movable manner (in directions indicated by arrows C1 and C2) between a position located close to the compilation load section 35 (i.e., a position Pax denoted by a solid line) and a position located away from the compilation load section 35 (i.e., a position Pay denoted by a dashed line). The second tamper 38*b* is disposed in a movable manner (in directions indicated by arrows C3 and C4) between a position located close to the compilation load section 35 (i.e., a position Pbx denoted by a solid line) and a position located away from the compilation load section 35 (i.e., a position Pby denoted by a dashed line).

Furthermore, the tamper 38 is configured to align the aforementioned edges of each sheet S by pushing one of the edges in a direction that intersects the traveling direction of the sheets S. In other words, the tamper 38 acts on the edges of the sheets S so as to bring the sheets S closer to each other. Unlike the second paddle 36 and the first paddle 37 described above, even if there is a stack of multiple sheets S, the tamper 38 can still come into contact with the edges of the sheet or sheets S stacked below the uppermost sheet S, whereby the lower sheet or sheets S may be aligned with the uppermost sheet S.

The first tamper 38*a* and the second tamper 38*b* in this exemplary embodiment can be moved to the corresponding positions Pax, Pay, Pbx, and Pby in accordance with the size and the orientation of the sheet or sheets S fed to the compilation load section 35.

The eject roller 39 (see FIG. 1) includes a first eject roller 39*a* and a second eject roller 39*b*. The first eject roller 39*a* and the second eject roller 39*b* are disposed with the base 35*a* of the compilation load section 35 interposed therebetween and face each other from the upper side and the lower side, respectively, of the base 35*a*.

The first eject roller 39*a* is provided facing the surface of the base 35*a* of the compilation load section 35 on which sheets S are loaded. Moreover, the first eject roller 39*a* is movable toward and away from the second eject roller 39*b* by receiving a driving force from a motor or the like (not shown). Specifically, the distance between the first eject roller 39*a* and the sheet or sheets S loaded on the base 35*a* of the compilation load section 35 is changeable. On the other hand, the second eject roller 39*b* is disposed facing the underside of the surface, on which sheets S are loaded, of the base 35*a* of the compilation load section 35. The second eject roller 39*b* is fixed in position so as to only perform rotation at the fixed position.

Specifically, the first eject roller 39*a* moves in a direction indicated by an arrow Q1 so that the first eject roller 39*a* moves toward the base 35*a* of the compilation load section 35 (to a position P2 denoted by a dashed line). The first eject roller 39*a* also moves in a direction indicated by an arrow Q2 so that the first eject roller 39*a* moves away from the base 35*a* of the compilation load section 35 (to a position P1 denoted by a solid line).

While being in contact with the uppermost sheet S, the first eject roller 39*a* receives a driving force from a motor or the like (not shown) and thus rotates in a direction indicated by an arrow T1 so as to transport the sheet bundle upward (that is, in the third traveling direction A3).

The first eject roller 39*a* can be moved to the position P1 or P2 in accordance with the number and the thickness of sheets S fed to the compilation load section 35.

Operation of Image Forming System 1

Next, the operation of the image forming system 1 will be described with reference to FIGS. 1 to 3.

First, in this exemplary embodiment, information related to an image to be formed on each sheet S and a binding process is received via a personal computer (not shown), the user interface 90, or the like. When the controller 80 receives the information, the operation of the image forming system 1 commences.

Before a toner image is formed on a first sheet S by the image forming unit 6 in the image forming device 2, each of the components is disposed as follows. Specifically, the first eject roller 39*a* is disposed at the position P1, the second paddle 36 is disposed at the position Pa, the first tamper 38*a* is disposed at the position Pay, and the second tamper 38*b* is disposed at the position Pbx.

Then, a toner image is formed on the first sheet S by the image forming unit 6 in the image forming device 2. As shown in FIG. 1, the first sheet S having the toner image formed thereon is inverted by the sheet inverting unit 7, where necessary, and is subsequently fed to the sheet processing device 3 via the discharge roller 9.

In the transport unit 10 of the sheet processing device 3 supplied with the first sheet S, the first sheet S is detected by the reception sensor Sr1. Then, the first sheet S is received by the receiving roller 11 and undergoes a hole-punching process by the puncher 12, where necessary. Subsequently, the first sheet S is transported downstream toward the post-processing device 30 via the first transport roller 13 and the second transport roller 14.

In the post-processing device 30, the third transport roller 31 receives the first sheet S. The first sheet S traveling through the third transport roller 31 is detected by the exit sensor Sr2, and is subsequently transported in the first traveling direction A1 by the exit roller 34. In this case, the first sheet S is transported so as to travel between the compilation load section 35 and the first eject roller 39*a* and between the compilation load section 35 and the second paddle 36.

After the leading edge of the first sheet S in the first traveling direction A1 passes through between the compilation load section 35 and the second paddle 36, the second paddle 36 descends from the position Pa to the position Pb (namely, moves in the direction of the arrow U1 in FIG. 2). In this case, the second paddle 36 and the first sheet S both descend so that the descending speed of the first sheet S increases. While the second paddle 36 in the descended state is in contact with the first sheet S, the second paddle 36 rotates in the direction of the arrow R in FIG. 2. Consequently, the first sheet S is pushed in the second traveling direction A2. Moreover, the first paddle 37 disposed downstream of the second paddle 36 also rotates in the direction of the arrow R so that the first sheet S is pushed further in the second traveling direction A2 in FIG. 2, whereby the edge of the first sheet S at the end guide 35*b* side comes into contact with the end guide 35*b*. Subsequently, the second paddle 36 ascends (namely, moves in the direction of the arrow U2 in FIG. 2) so as to move away from the first sheet S, thereby returning to the position Pa.

After the first sheet S is received by the compilation load section 35 and the edge of the first sheet S at the end guide 35*b* side reaches the end guide 35*b*, the first tamper 38*a* moves toward the compilation load section 35 from the position Pay (namely, moves in the direction of the arrow C2 in FIG. 3) so as to be disposed at the position Pax. In this case, the second tamper 38*b* remains at the position Pbx. Consequently, the first tamper 38*a* pushes against the corresponding lateral edge of the first sheet S so as to bring the first sheet S into contact with the second tamper 38*b*. Subsequently, the first tamper 38*a* moves away from the compilation load section 35 (namely, moves in the direction of the arrow C1 in FIG. 3) so as to move away from the first sheet S, thereby returning to the position Pay.

When a second sheet S and onward subsequent to the first sheet S and having toner images formed thereon by the image forming unit 6 are sequentially fed to the post-processing device 30, the edges of the sheets S are aligned with each other. Specifically, the second sheet S is fed while the first sheet S is in the aligned state, and the second sheet S is aligned with the first sheet S. This similarly applies to when a third sheet S and onward are fed. Consequently, a predetermined number of sheets S are accommodated in the compilation load section 35, and the edges of the sheets S are aligned with each other, thereby forming a sheet bundle.

Then, the first eject roller 39*a* descends from the position P1 to the position P2 (namely, moves in the direction of the arrow Q1 in FIG. 2). Thus, the sheet bundle in the aligned state is fixed in position by being sandwiched between the first eject roller 39*a* and the second eject roller 39*b*.

Subsequently, the stapler 50 performs a binding process on the sheet bundle loaded on the compilation load section 35. The sheet bundle bound together by the stapler 50 moves upward along the base 35*a* of the compilation load section 35 (see the third traveling direction A3 in FIG. 2) due to rotation of the first eject roller 39*a* (in the direction of the arrow T1 in FIG. 2) so as to be discharged from the compilation load section 35. Then, the sheet bundle travels through the opening 69 so as to be ejected onto the load section 70.

Distances Between Sheets

Next, the distances between transported sheets S will be described below with reference to FIGS. 4A to 4C.

Figures 4A, 4B, 4C:
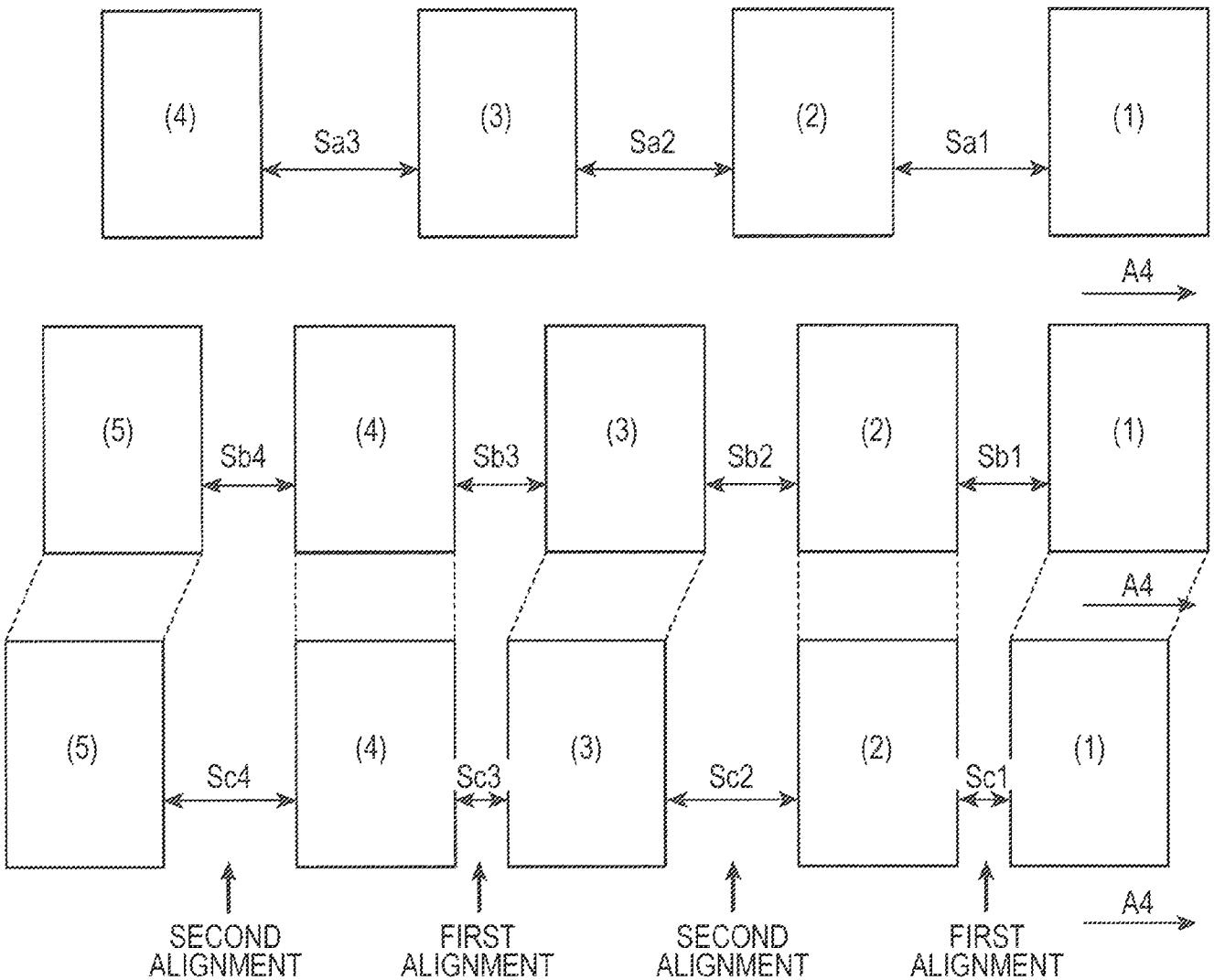
FIGS. 4A to 4C are diagrams for explaining distances between transported sheets.

FIGS. 4A to 4C are diagrams for explaining the distances between transported sheets S. In FIGS. 4A to 4C, the sheets S (denoted by reference numerals (1) to (5)) are transported in a direction indicated by an arrow A4 in the order shown in the diagrams.

FIG. 4A illustrates a first sheet transport mode. In the example shown in FIG. 4A, the sheets S (denoted by reference numerals (1) to (4)) are transported at predetermined intervals. Specifically, distances Sa1, Sa2, and Sa3 between the sheets S (referred to as "sheet-to-sheet distances" hereinafter) are constant. When the sheets S transported as shown in FIG. 4A reach the compilation load section 35, a sheet alignment process is performed on the sheets S in time periods corresponding to the sheet-to-sheet distances Sa1, Sa2, and Sa3. Specifically, in a time period (referred to as "sheet-to-sheet time period" hereinafter) from a time point at which a certain sheet S is transported to the compilation load section 35 to a time point at which a subsequent sheet S is transported to the compilation load section 35, the second paddle 36, the first paddle 37, and the tamper 38 perform the sheet alignment process in the above-described manner.

If the output of sheets S in the image forming system 1 is to be increased, the sheet-to-sheet distances are sometimes reduced, as shown in FIG. 4B.

FIG. 4B illustrates a second sheet transport mode. In detail, in the second sheet transport mode, the sheet-to-sheet distances are smaller than in the first sheet transport mode shown in FIG. 4A.

In the example shown in FIG. 4B, sheet-to-sheet distances Sb1, Sb2, Sb3, and Sb4 are equal to each other, as in the example shown in FIG. 4A. On the other hand, the sheet-to-sheet distances Sb1, Sb2, Sb3, and Sb4 in the example shown in FIG. 4B are smaller than the sheet-to-sheet distances Sa1, Sa2, and Sa3 shown in FIG. 4A. Therefore, if the sheet transport speed is the same between the example shown in FIG. 4A and the example shown in FIG. 4B, the number of sheets S to be output within the same time period is greater in FIG. 4B.

When the sheet-to-sheet distances Sb1, Sb2, Sb3, and Sb4 are small, there is a possibility that the second paddle 36, the first paddle 37, and the tamper 38 may not have enough time to perform the alignment process on the sheets S. In detail, when the tamper 38 performs the alignment process on a certain sheet S after the second paddle 36 and the first paddle 37 have performed the alignment process on the certain sheet S, there may be a case where a subsequent sheet S is transported to the compilation load section 35 before the tamper 38 completes the alignment process on the certain sheet S.

The expression "before the tamper 38 completes the alignment process" refers to a state where, for example, the subsequent sheet S is transported to the compilation load section 35 while the first tamper 38*a* (see FIG. 3) of the tamper 38 is still moving from the position Pay to the position Pax for performing the alignment process on the certain sheet S.

In this case, for example, the subsequent sheet S may land on the moving first tamper 38*a* or the subsequent sheet S may bounce off the moving first tamper 38*a*, causing the subsequent sheet S to be positionally displaced on the compilation load section 35.

As one conceivable mode, the sheet alignment process by the second paddle 36 and the first paddle 37 and the sheet alignment process by the tamper 38 may be simultaneously performed instead of performing the sheet alignment process by the tamper 38 after the sheet alignment process by the second paddle 36 and the first paddle 37. In other words, in this mode, the timing at which the second paddle 36 and the first paddle 37 perform the sheet alignment process overlaps the timing at which the tamper 38 performs the sheet alignment process.

However, in this mode, there is sometimes a case where the edges of a sheet S are not aligned, as compared with the mode in which the sheet alignment process by the second paddle 36 and the first paddle 37 and the sheet alignment process by the tamper 38 are sequentially performed.

In detail, as described above, the second paddle 36 and the first paddle 37 come into contact with the surface of the uppermost sheet S and make the sheet S travel in the transport direction (see the second traveling direction A2 in FIG. 3) so as to align the leading edge of the sheet S. The tamper 38 aligns the lateral edges of the sheet S by pushing the sheet S in the direction (i.e., the vertical direction in FIG. 3) that intersects the transport direction of the sheet S. Therefore, the tamper 38 pushes the sheet S while the sheet S is retained by the second paddle 36 and the first paddle 37.

The retaining force applied to the sheet S by the second paddle 36 and the first paddle 37 may possibly act as resistance against the moving force applied to the sheet S by the tamper 38. Therefore, the sheet S may become skewed, possibly resulting in the sheet S being disposed slantwise on the compilation load section 35. In other words, the sheet S may become disposed with the two orthogonal edges thereof in an unaligned state.

There may be another case where the sheet S cannot be moved to a predetermined position (namely, to the second tamper 38*b* disposed at the position Pbx in the example in FIG. 3) by the tamper 38, resulting in an inability to align the lateral edges of the sheet S.

In this exemplary embodiment, the operation (first sheet alignment mode or first mode) for simultaneously performing the sheet alignment process by the second paddle 36 and the first paddle 37 and the sheet alignment process by the tamper 38 and the operation (second sheet alignment mode or second mode) for sequentially performing the sheet alignment process by the second paddle 36 and the first paddle 37 and the sheet alignment process by the tamper 38 are alternately performed at appropriate intervals. Furthermore, in this exemplary embodiment, the interval between sheets (referred to as "sheet-to-sheet interval" hereinafter) is extended for every multiple sheets so that long sheet-to-sheet intervals and short sheet-to-sheet intervals are provided. In each short sheet-to-sheet interval, the edges of each sheet S are aligned based on the first sheet alignment mode, and in each long sheet-to-sheet interval, the edges of each sheet S are aligned based on the second sheet alignment mode.

In other words, by extending the sheet-to-sheet interval for every multiple sheets, the time for aligning each sheet S by sequentially using the second paddle 36, the first paddle 37, and the tamper 38 is ensured. Consequently, even if a sheet S is not completely aligned in the first sheet alignment mode, multiple sheets S may collectively be aligned in the second sheet alignment mode.

As described above, the tamper 38 is configured to align the lateral edges of each sheet S by pushing one of the lateral edges of the sheet S (see FIG. 3). Even if there is a stack of multiple sheets S, the tamper 38 can still come into contact with the edges of the sheet or sheets S stacked below the uppermost sheet S. Consequently, even if a sheet S is not completely aligned in the first sheet alignment mode, the tamper 38 may collectively align multiple sheets S in the second sheet alignment mode.

An example of a sheet transport mode according to this exemplary embodiment will now be described with reference to FIG. 4C.

FIG. 4C illustrates the sheet transport mode according to this exemplary embodiment.

In this exemplary embodiment, the sheet-to-sheet interval is extended for every multiple sheets, as described above, and the second sheet alignment mode is performed in each long sheet-to-sheet interval. In other words, in each long sheet-to-sheet interval, the sheet alignment process by the second paddle 36 and the first paddle 37 and the sheet alignment process by the tamper 38 are sequentially performed. In the example shown in FIG. 4C, large sheet-to-sheet distances Sc2 and Sc4 and small sheet-to-sheet distances Sc1 and Sc3 are alternately provided so as to ensure enough time for the alignment process based on the second sheet alignment mode for every other sheet.

In the large sheet-to-sheet distances Sc2 and Sc4, the sheet alignment process is performed based on the second sheet alignment mode (second sheet alignment in FIG. 4C). In the small sheet-to-sheet distances Sc1 and Sc3, the sheet alignment process is performed based on the first sheet alignment mode (first sheet alignment in FIG. 4C).

The large sheet-to-sheet distances Sc2 and Sc4 are set so as to ensure enough time for performing the sheet alignment process based on the second sheet alignment mode. More specifically, the sheet-to-sheet time period corresponding to each of the large sheet-to-sheet distances Sc2 and Sc4 is enough time for sequentially performing the sheet alignment process by the second paddle 36 and the first paddle 37 and the sheet alignment process by the tamper 38. In other words, the second sheet alignment mode takes a longer time than the first sheet alignment mode.

On the other hand, the small sheet-to-sheet distances Sc1 and Sc3 are set so as to ensure enough time for performing the sheet alignment process based on the first sheet alignment mode. More specifically, the sheet-to-sheet time period corresponding to each of the small sheet-to-sheet distances Sc1 and Sc3 is enough time for the last one of the second paddle 36, the first paddle 37, and the tamper 38 to complete the sheet alignment process.

When the example shown in FIG. 4B and the example shown in FIG. 4C are compared with each other, the distance from a first sheet S (denoted by reference numeral (1)) to a third sheet S (denoted by reference numeral (3)), i.e., two sheets after the first sheet S, is the same between the two examples.

Operation Example of Sheet Processing Device 3

In this exemplary embodiment, the sheet-to-sheet distances are changed based on the following configuration.

First, the distances between sheets S having images formed thereon and fed from the image forming device 2 in the image forming system 1 according to this exemplary embodiment are constant. In this exemplary embodiment, the sheet-to-sheet distances are changed in the sheet processing device 3. In detail, the transport speed of a specific sheet S is reduced at a part of the sheet transport path. Thus, the distances between the specific sheet S reduced in speed and other sheets S before and after the specific sheet S are changed.

In this exemplary embodiment, the rotation speed of the receiving roller 11 in the transport unit 10 is changed for each sheet S. Referring to the above-described example shown in FIG. 4C, when the receiving roller 11 transports the sheets S denoted by reference numerals (1), (3), and (5), the receiving roller 11 transports these sheets S at low speed. In contrast, when the receiving roller 11 transports the sheets S denoted by reference numerals (2) and (4), the receiving roller 11 transports these sheets S at high speed. Consequently, the sheet-to-sheet distances Sc2 and Sc4 become larger than the sheet-to-sheet distances Sc1 and Sc3.

Next, the operation example of the sheet processing device 3 will be described in more detail with reference to FIG. 5.

Figure 5:
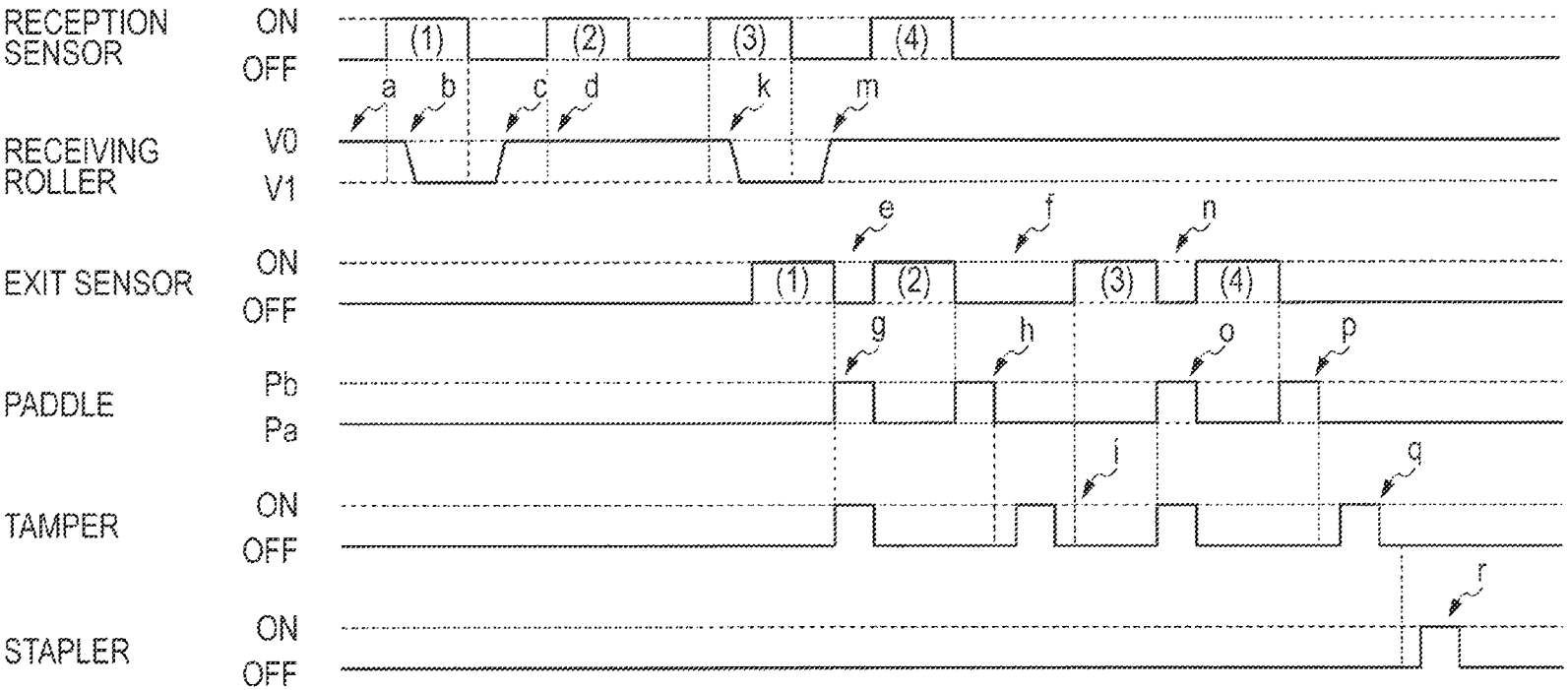
FIG. 5 is a timing chart illustrating an operation example of a sheet processing device according to the exemplary embodiment.

FIG. 5 is a timing chart illustrating the operation example of the sheet processing device 3 according to this exemplary embodiment. In the following description, according to the order in which images are formed and transported by the image forming device 2, the first sheet S will be referred to as "sheet S1" (denoted by reference numeral (1)), and the subsequent sheets S will sequentially be referred to as "sheet S2" (denoted by reference numeral (2)), "sheet S3" (denoted by reference numeral (3)), and "sheet S4" (denoted by reference numeral (4)).

In this exemplary embodiment, the sheets S having the images formed thereon are fed from the image forming device 2 at fixed intervals. In this case, the receiving roller 11 rotates at rotation speed V0 (reference character a). Then, after the reception sensor Sr1 detects the sheet S1, the rotation speed of the receiving roller 11 is reduced from V0 to V1 (reference character b), so that the receiving roller 11 transports the sheet S1 at speed V1.

In this exemplary embodiment, the timing at which the speed of the receiving roller 11 is reduced to V1 is after the leading edge of a sheet S in the transport direction reaches the receiving roller 11 as well as after the trailing edge of the sheet S passes through the discharge roller 9. With regard to the speed of the receiving roller 11, for example, the speed V0 is set at 350 mm/s, and the speed V1 is set at 250 mm/s.

After the reception sensor Sr1 no longer detects the sheet S1, the speed of the receiving roller 11 is increased from V1 to V0 (reference character c). Then, the receiving roller 11 rotates so as to transport the next sheet S2 at the speed V0 (reference character d).

Accordingly, in this exemplary embodiment, every time the reception sensor Sr1 detects that a sheet S has passed, the speed of the receiving roller 11 is switched between V0 and V1. More specifically, every time the reception sensor Sr1 detects that a sheet S has passed, the receiving roller 11 is repeatedly increased and reduced in speed.

In this exemplary embodiment, the first transport roller 13, the second transport roller 14, the third transport roller 31, and the exit roller 34 that are disposed downstream of the receiving roller 11 in the sheet transport direction transport each sheet S at the speed V0 without changing the speeds of these rollers.

In this exemplary embodiment, the receiving roller 11 transports the sheet S1 and the sheet S3 at the speed V1, which is lower than the speed V0, and transports the sheet S2 at the speed V0. Thus, at the exit sensor Sr2 located downstream of the receiving roller 11 in the sheet transport direction, the sheet-to-sheet interval (reference character e) between the sheet S1 and the sheet S2 has a length different from that of the sheet-to-sheet interval (reference character f) between the sheet S2 and the sheet S3. Specifically, the sheet-to-sheet interval (reference character f) between the sheet S2 and the sheet S3 is greater than the sheet-to-sheet interval (reference character e) between the sheet S1 and the sheet S2.

After the sheet S1 passes through the exit sensor Sr2 and is fed to the compilation load section 35, the alignment process is performed on the sheet S1 based on the first sheet alignment mode. Specifically, the second paddle 36 moves from the position Pa to the position Pb so as to perform the sheet alignment process, and the tamper 38 simultaneously performs the sheet alignment process (reference character g). In this case, although not shown in FIG. 5, the first paddle 37 also performs the sheet alignment process.

After the second paddle 36, the first paddle 37, and the tamper 38 complete the alignment process on the sheet S1, the sheet S2 is fed to the compilation load section 35. The sheet S2 undergoes the alignment process based on the second sheet alignment mode. Specifically, after the second paddle 36 and the first paddle 37 perform the sheet alignment process (reference character h), the tamper 38 performs the sheet alignment process (reference character i).

Because the sheet-to-sheet interval (reference character f) between the sheet S2 and the sheet S3 is extended by reducing the speed of the receiving roller 11, as described above, the sheet S3 is fed to the compilation load section 35 after the tamper 38 completes the sheet alignment process on the sheet S2. Since the sheet S3 is fed to the compilation load section 35 after the tamper 38 completes the sheet alignment process on the sheet S2, the sheet S3 is prevented from, for example, bouncing off the tamper 38 moving for aligning the sheet S2.

In the example shown in FIG. 5, the first sheet alignment mode and the second sheet alignment mode may be regarded as modes with different time periods (alignment start time periods) from a time point at which a sheet S is fed to the compilation load section 35 to a time point at which the tamper 38 starts the alignment process on the sheet S. More specifically, the alignment start time period in the first sheet alignment mode is shorter than the alignment start time period in the second sheet alignment mode.

Similar to how the sheet S1 and the sheet S2 are processed as described above, the sheet S3 and the sheet S4 that are transported subsequent to the sheet S2 are processed. Specifically, after the reception sensor Sr1 detects the sheet S3, the rotation speed of the receiving roller 11 is reduced from V0 to V1 (reference character k), and the rotation speed of the receiving roller 11 is subsequently increased to V0 (reference character m). Thus, the sheet-to-sheet interval (reference character f) between the sheet S2 and the sheet S3 becomes greater than the sheet-to-sheet interval (reference character n) between the sheet S3 and the sheet S4.

Then, after the sheet S3 is fed to the compilation load section 35, the alignment process is performed on the sheet S3 based on the first sheet alignment mode. Specifically, the second paddle 36 moves from the position Pa to the position Pb so as to perform the sheet alignment process, and the tamper 38 simultaneously performs the sheet alignment process (reference character o). On the other hand, after the sheet S4 is fed to the compilation load section 35, the alignment process is performed on the sheet S4 based on the second sheet alignment mode. Specifically, after the sheet alignment process is performed by the second paddle 36 and the first paddle 37 (reference character p), the tamper 38 performs the sheet alignment process (reference character q).

Subsequently, the stapler 50 performs the binding process (reference character r) on the sheets S1 to S4 loaded on the compilation load section 35.

In this exemplary embodiment, for example, the first transported sheet S having an image formed thereon by the image forming device 2 is transported at the speed V1 by the receiving roller 11, and when this first sheet S is fed to the compilation load section 35, the sheet S undergoes the alignment process based on the first sheet alignment mode. Subsequently, the first sheet alignment mode and the second sheet alignment mode are alternately performed. Specifically, as described above, every time the reception sensor Sr1 detects that a sheet S has passed, the speed of the receiving roller 11 is switched between V0 and V1. Furthermore, every time the exit sensor Sr2 detects that a sheet S has passed, the switching between the first sheet alignment mode and the second sheet alignment mode is performed.

Accordingly, when performing the sheet alignment process based on the second sheet alignment mode for every multiple sheets, the sheet S (i.e., the sheet S2 or the sheet S4) transported at the speed V0 by the receiving roller 11 is fed to the compilation load section 35. When performing the sheet alignment process based on the first sheet alignment mode, the sheet S (i.e., the sheet S1 or the sheet S3) transported at the speed V1 by the receiving roller 11 is fed to the compilation load section 35.

Modifications

With regard to the first sheet alignment mode and the second sheet alignment mode in the above exemplary embodiment, the alignment start time period by the tamper 38 in the first sheet alignment mode and the alignment start time period by the tamper 38 in the second sheet alignment mode are different from each other.

In the first sheet alignment mode, the sheet alignment process by the second paddle 36 and the first paddle 37 and the sheet alignment process by the tamper 38 may be simultaneously performed. In the second sheet alignment mode, the sheet alignment process by the second paddle 36 and the first paddle 37 and the sheet alignment process by the tamper 38 may be sequentially performed.

Therefore, the tamper 38 may be configured to perform the sheet alignment process in different modes between the first sheet alignment mode and the second sheet alignment mode.

For example, the tamper 38 may be configured to perform the sheet alignment process at different speeds between the first sheet alignment mode and the second sheet alignment mode. Specifically, the speed at which the first tamper 38*a* of the tamper 38 moves in the first sheet alignment mode may be lower than the speed at which the first tamper 38*a* of the tamper 38 moves in the second sheet alignment mode. Thus, forces acting in intersecting directions are simultaneously applied to a sheet S in the first sheet alignment mode, as described above, whereby the edges of the sheet S may be prevented from being misaligned.

As another example, the number of times the tamper 38 performs the sheet alignment process may be changed between the first sheet alignment mode and the second sheet alignment mode. Specifically, in the first sheet alignment mode, the first tamper 38*a* may move from the position Pay to the position Pax and then move again to the position Pay so as to perform the sheet alignment process once. On the other hand, in the second sheet alignment mode, the first tamper 38*a* of the tamper 38 may move from the position Pay to the position Pax and then move again to the position Pay so as to repeatedly perform the sheet alignment process twice. Consequently, in the second sheet alignment mode, the edges of the sheet S may be further prevented from being misaligned, as compared with a case where the sheet alignment process is performed once.

As another example, if the first tamper 38*a* of the tamper 38 is configured to perform the sheet alignment process twice in each of the first sheet alignment mode and the second sheet alignment mode, the first tamper 38*a* may be configured to move differently between the two modes.

In detail, in the first sheet alignment mode, the following operation may be performed when the first tamper 38*a* of the tamper 38 repeatedly performs the sheet alignment process twice. Specifically, in a first sheet alignment process, the first tamper 38*a* moves from the position Pay to the position Pax and subsequently moves to a position Paz (see FIG. 3) located between the position Pay and the position Pax. Then, in a second sheet alignment process, the first tamper 38*a* moves from the position Paz to the position Pax and subsequently moves to the position Pay.

On the other hand, in the second sheet alignment mode, the first tamper 38*a* moves from the position Pay to the position Pax and then moves again to the position Pay so as to repeatedly perform the sheet alignment process twice. Consequently, the time that it takes to perform the first sheet alignment process in the first sheet alignment mode is shortened.

In the above exemplary embodiment, the transport speed of a specific sheet S is reduced by reducing the rotation speed of the receiving roller 11. Alternatively, the distances between the specific sheet S and other sheets S before and after the specific sheet S may be changed by, for example, temporarily stopping the receiving roller 11 when the specific sheet S is transported, so long as the distances between the specific sheet S and the other sheets can be changed.

Furthermore, the specific sheet S may be reduced in speed or may be stopped by components other than the receiving roller 11, such as the first transport roller 13, the second transport roller 14, the third transport roller 31, and the exit roller 34, which are provided downstream of the receiving roller 11 in the sheet transport direction.

In the above exemplary embodiment, the sheet alignment process based on the second sheet alignment mode is performed for every other sheet, as shown in FIG. 4C. Alternatively, the sheet alignment process based on the second sheet alignment mode may be performed for every multiple sheets. This will be described in detail below with reference to FIGS. 6A and 6B.

Figure 6A:
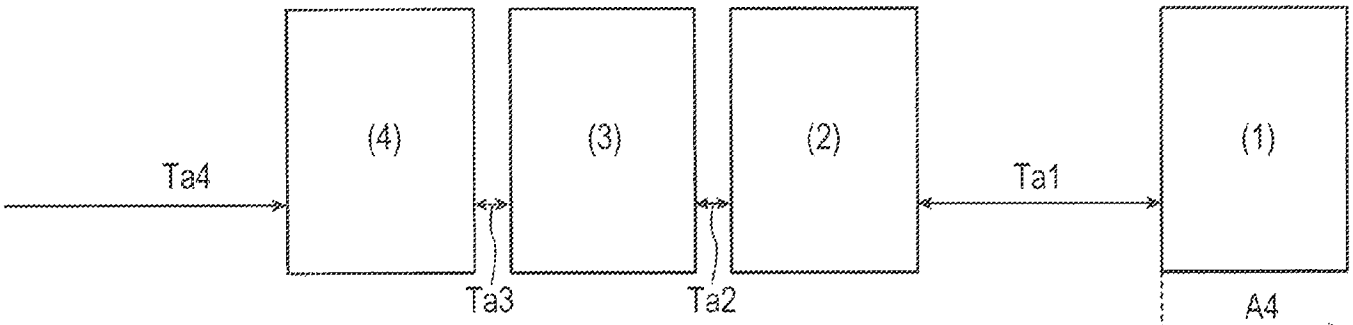
FIGS. 6A and 6B are diagrams for explaining a modification of the distances between transported sheets.
Figure 6B:
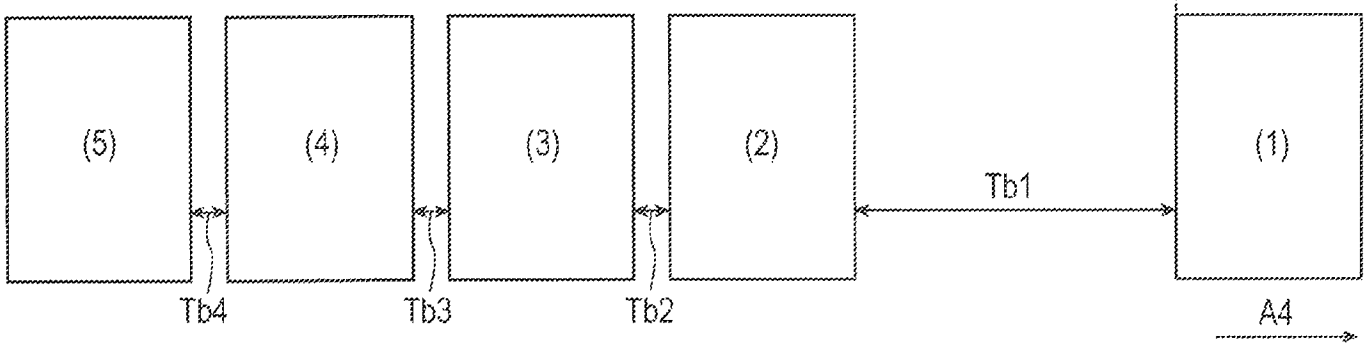

FIGS. 6A and 6B are diagrams for explaining a modification of the distances between transported sheets S.

Referring to FIG. 6A, the time for performing the sheet alignment process based on the second sheet alignment mode is ensured by increasing the sheet-to-sheet distance for every two sheets S. In the example shown in FIG. 6A, a sheet-to-sheet distance Ta1 and a sheet-to-sheet distance Ta4 are larger than a sheet-to-sheet distance Ta2 and a sheet-to-sheet distance Ta3. The sheet-to-sheet distance Ta2 and the sheet-to-sheet distance Ta3 are equal to each other.

In the large sheet-to-sheet distance Ta1 (and the large sheet-to-sheet distance Ta4), the sheet alignment process is performed based on the second sheet alignment mode. In the small sheet-to-sheet distance Ta2 (and the small sheet-to-sheet distance Ta3), the sheet alignment process is performed based on the first sheet alignment mode.

Alternatively, as shown in FIG. 6B, the time for performing the sheet alignment process based on the second sheet alignment mode may be ensured by increasing the sheet-to-sheet distance for every three sheets S. In the example shown in FIG. 6B, a sheet-to-sheet distance Tb1 is larger than a sheet-to-sheet distance Tb2, a sheet-to-sheet distance Tb3, and a sheet-to-sheet distance Tb4. The sheet-to-sheet distance Tb2, the sheet-to-sheet distance Tb3, and the sheet-to-sheet distance Tb4 are equal to each other.

In the large sheet-to-sheet distance Tb1, the sheet alignment process is performed based on the second sheet alignment mode. In the small sheet-to-sheet distances Tb2, Tb3, and Tb4, the sheet alignment process is performed based on the first sheet alignment mode.

In the above exemplary embodiment, the combination of a large sheet-to-sheet distance and a small sheet-to-sheet distance is repeated, as shown in FIG. 4C. The image forming system 1 according to this exemplary embodiment may be configured to operate in, for example, a high-speed mode and a low-speed mode.

Specifically, in the high-speed mode, the sheet-to-sheet distance is changed for each sheet S, and the sheet alignment mode is changed between the first sheet alignment mode and the second sheet alignment mode, as described above with reference to FIG. 4C and the like, so as to increase the output of sheets S in the image forming system 1. In the low-speed mode, the second paddle 36, the first paddle 37, and the tamper 38 sequentially perform the sheet alignment process every time a sheet S is fed to the compilation load section 35 without changing the sheet-to-sheet distance so that the alignment process is reliably performed on the sheet S.

The switching between the high-speed mode and the low-speed mode is performed on the basis of an instruction received from the user via the personal computer (not shown), the user interface 90, or the like for designating the high-speed mode or the low-speed mode.

Alternatively, based on the information received via the personal computer (not shown), the user interface 90, or the like, the controller 80 may perform the switching between the high-speed mode and the low-speed mode. For example, the controller 80 compares the magnitude of an output requested in the received information (i.e., the number of sheets S to be output within the same time period) with a predetermined threshold value. Then, if the magnitude of the output is greater than the threshold value, the controller 80 may activate the image forming system 1 in the high-speed mode, or if the magnitude of the output is smaller than the threshold value, the controller 80 may activate the image forming system 1 in the low-speed mode.

In other words, the switching between the high-speed mode and the low-speed mode may be performed by changing the control by the controller 80 so that the output from the image forming system 1 may be increased and the sheet alignment process may be reliably performed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a transport section that transports a sheet transported at a predetermined speed from an upstream side toward a downstream side;

a load section on which the sheet transported from the transport section is loaded;

a first aligner that moves the sheet transported to the load section while being in contact with a surface of the sheet so as to perform an alignment process on the sheet;

a second aligner that moves the sheet transported to the load section while being in contact with an edge of the sheet so as to perform an alignment process on the sheet;

an alignment controller that performs control such that the first aligner and the second aligner perform the alignment process on the sheet transported to the load section based on a first mode in which the second aligner performs the alignment process while the first aligner performs the alignment process on the sheet, and such that the first aligner and the second aligner perform the alignment process on the sheet transported to the load section based on a second mode, for every predetermined number of sheets, in which one of the first aligner and the second aligner performs the alignment process on the sheet after the other aligner completes the alignment process; and a transport controller that controls the transport section by causing the transport section to transport the sheet at a reduced speed relative to the predetermined speed for the every predetermined number of sheets so that the sheet transported at the reduced speed reaches the load section after completion of the alignment process based on the second mode performed after a previous sheet transported immediately prior to the sheet is loaded on the load section.

2. The post-processing device according to claim 1, wherein the second aligner performs the alignment process on the sheet by moving the sheet in a direction that intersects a direction in which the sheet is moved by the first aligner.

3. The post-processing device according to claim 1, wherein the alignment controller performs the control such that the first aligner and the second aligner perform the alignment process on the sheet based on the second mode for every other sheet, and wherein the transport controller causes the transport section to transport the sheet at the reduced speed for every other sheet.

4. The post-processing device according to claim 2, wherein the alignment controller performs the control such that the first aligner and the second aligner perform the alignment process on the sheet based on the second mode for every other sheet, and wherein the transport controller causes the transport section to transport the sheet at the reduced speed for every other sheet.

5. The post-processing device according to claim 1, wherein the second aligner performs the alignment process on the sheet by pushing the edge of the sheet.

6. The post-processing device according to claim 2, wherein the second aligner performs the alignment process on the sheet by pushing the edge of the sheet.

7. The post-processing device according to claim 3, wherein the second aligner performs the alignment process on the sheet by pushing the edge of the sheet.

8. The post-processing device according to claim 4, wherein the second aligner performs the alignment process on the sheet by pushing the edge of the sheet.

9. The post-processing device according to claim 1, wherein the first aligner moves the sheet while being intermittently in contact with the surface of the sheet.

10. The post-processing device according to claim 2, wherein the first aligner moves the sheet while being intermittently in contact with the surface of the sheet.

11. The post-processing device according to claim 3, wherein the first aligner moves the sheet while being intermittently in contact with the surface of the sheet.

12. The post-processing device according to claim 4, wherein the first aligner moves the sheet while being intermittently in contact with the surface of the sheet.

13. The post-processing device according to claim 5, wherein the first aligner moves the sheet while being intermittently in contact with the surface of the sheet.

14. The post-processing device according to claim 6, wherein the first aligner moves the sheet while being intermittently in contact with the surface of the sheet.

15. The post-processing device according to claim 7, wherein the first aligner moves the sheet while being intermittently in contact with the surface of the sheet.

16. The post-processing device according to claim 8, wherein the first aligner moves the sheet while being intermittently in contact with the surface of the sheet.

17. A post-processing device comprising:

a transport section that transports a sheet transported at a predetermined speed from an upstream side toward a downstream side;

a load section on which the sheet transported from the transport section is loaded;

an aligner that performs an alignment process on the sheet transported to the load section;

an alignment controller that performs control such that the aligner that performs the alignment process on the sheet based on a first mode when the sheet is transported to the load section, and such that the aligner performs the alignment process on the sheet based on a second mode for every predetermined number of sheets when the sheet is transported to the load section, the second mode being performed for a longer time period than the first mode; and a transport controller that controls the transport section by causing the transport section to transport the sheet at a reduced speed relative to the predetermined speed for the every predetermined number of sheets so that the sheet transported at the reduced speed reaches the load section after completion of the alignment process based on the second mode performed after a previous sheet transported immediately prior to the sheet is loaded on the load section.

18. An image forming apparatus comprising:

an image forming mechanism that forms an image on a sheet;

a transport section that transports the sheet, having the image formed thereon by the image forming mechanism, transported at a predetermined speed toward a downstream side;

a load section on which the sheet transported from the transport section is loaded;

a first aligner that moves the sheet transported to the load section while being in contact with a surface of the sheet so as to perform an alignment process on the sheet;

a second aligner that moves the sheet transported to the load section while being in contact with an edge of the sheet so as to perform an alignment process on the sheet;

an alignment controller that performs control such that the first aligner and the second aligner perform the alignment process on the sheet transported to the load section based on a first mode in which the second aligner performs the alignment process while the first aligner performs the alignment process on the sheet, and such that the first aligner and the second aligner perform the alignment process on the sheet transported to the load section based on a second mode, for every predetermined number of sheets, in which one of the first aligner and the second aligner performs the alignment process on the sheet after the other aligner completes the alignment process; and a transport controller that controls the transport section by causing the transport section to transport the sheet at a reduced speed relative to the predetermined speed for the every predetermined number of sheets so that the sheet transported at the reduced speed reaches the load section after completion of the alignment process based on the second mode performed after a previous sheet transported immediately prior to the sheet is loaded on the load section.

* * * * *